US005993578A

United States Patent [19]

Timmerman

[11] Patent Number: 5,993,578

[45] Date of Patent: Nov. 30, 1999

[54] METHOD OF DRYING PYROTECHNIC COMPOSITIONS

[75] Inventor: Hubert G. Timmerman, Manhattan Beach, Calif.

[73] Assignee: Special Devices, Inc., Newhall, Calif.

[21] Appl. No.: 09/060,871

[22] Filed: Apr. 15, 1998

[51] Int. Cl.[6] ..... D03D 23/00; C06B 45/10; C06B 21/00

[52] U.S. Cl. ..... 149/109.6; 149/19.3; 149/19.92; 149/19.93; 264/3.4

[58] Field of Search ..... 149/108.2, 19.92, 149/20, 109.6, 110, 111, 114, 19.3, 19.93; 102/292; 264/3.1, 3.4, 3.5, 3.6

[56] References Cited

U.S. PATENT DOCUMENTS

| | | | |
|---|---|---|---|
| 3,255,059 | 6/1966 | Hamermesh et al. | 149/19 |
| 3,652,350 | 3/1972 | Timmerman . | |
| 3,862,866 | 1/1975 | Timmerman et al. | 149/21 |
| 3,971,729 | 7/1976 | Timmerman | 252/187 |
| 4,094,949 | 6/1978 | Yokokawa et al. | 264/234 |
| 4,353,853 | 10/1982 | Swift | 264/41 |
| 5,648,634 | 7/1997 | Avory et al. | 102/202.1 |

*Primary Examiner*—Charles T. Jordan
*Assistant Examiner*—Aileen J. Baker
*Attorney, Agent, or Firm*—Lyon & Lyon LLP

[57] ABSTRACT

Disclosed is an improved method of drying a slurry of adhesive particles and counter-solvent such as a slurry of pyrotechnic particles and counter-solvent produced by the precipitation method, wherein the counter-solvent is evaporated from the slurry for a period of time under turbulence so as to prevent caking or aggregation of the particles.

21 Claims, 2 Drawing Sheets

METHOD OF DRYING PYROTECHNIC COMPOSITIONS

FIELD OF THE INVENTION

The field of the invention relates to the drying of slurries of adhesive particles, such as binder-coated pyrotechnic particles, to produce dry, non-adhesive, individuated particles.

DESCRIPTION OF THE PRIOR ART

Pyrotechnic compositions are now frequently prepared using a "precipitation method." This method involves the precipitation of a coating of elastomeric rubber onto active pyrotechnic particles that are suspended, through stirring, in a solution comprising elastomeric rubber dissolved in a blending solvent. The precipitation is triggered by the introduction of a counter-solvent in which not only are the pyrotechnic particles insoluble, but also the elastomeric rubber. The pyrotechnic particles settle once a sufficient amount of rubber has precipitated onto them, allowing them to be separated from the solution and dried. The precipitation method was developed by the Applicant and patented in U.S. Pat. No. 3,652,350, issued Mar. 28, 1972. That patent and its teachings are incorporated by reference as if set forth fully herein.

The settled particles produced according to the precipitation method are typically separated from the solution and prepared for drying in a few steps. First, the liquid is decanted from the settled particles. Then, the particles are rinsed with the counter-solvent. Finally, a wet mixture, or slurry, including the particles is poured through an appropriately-sized screen under the counter-solvent, and spread wet into a steel drying pan.

It is at this point, however, where problems have been encountered in the preparation of pyrotechnics through the precipitation method. Heretofore, the particles have been spread in the steel drying pan, allowed to air dry for some time, and then dried in an oven for final drying. When removed from the oven, the particles adhere together in an unusable "cake" in the drying pan. To produce the desired granules, the cake is pressed through a screen with a receiving pan beneath it. The contents of the receiving pan are then dumped into a non-conductive container.

The cake screening and pan dumping steps, however, can result in fires and explosions. Accordingly, there is a need for a reliable method of drying adhesive particles such as pyrotechnic granules or particles produced by the precipitation method.

SUMMARY OF THE INVENTION

The present invention is directed to an improved method of drying a slurry including adhesive particles and a counter-solvent, wherein the slurry is initially agitated while counter-solvent is evaporated off until the particles are no longer adhesive enough to tend to cake together. In a first aspect of the present invention, such particles are poured in a wet slurry including counter-solvent into a non-conductive pitcher, and then promptly sent to a vacuum oven where the counter-solvent is turbulently boiled off. In a second aspect of the present invention, mechanical means such as a stirrer are used to impose the aforementioned agitation or turbulence.

BRIEF DESCRIPTION OF THE DRAWINGS

The FIGURE is a process flow diagram showing the drying of pyrotechnic particles produced by the precipitation method.

DETAILED DESCRIPTION OF THE INVENTION

Figure 1:
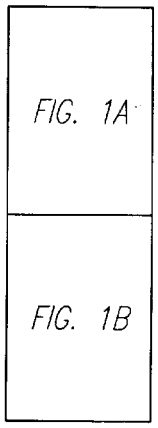
Figure 1A:
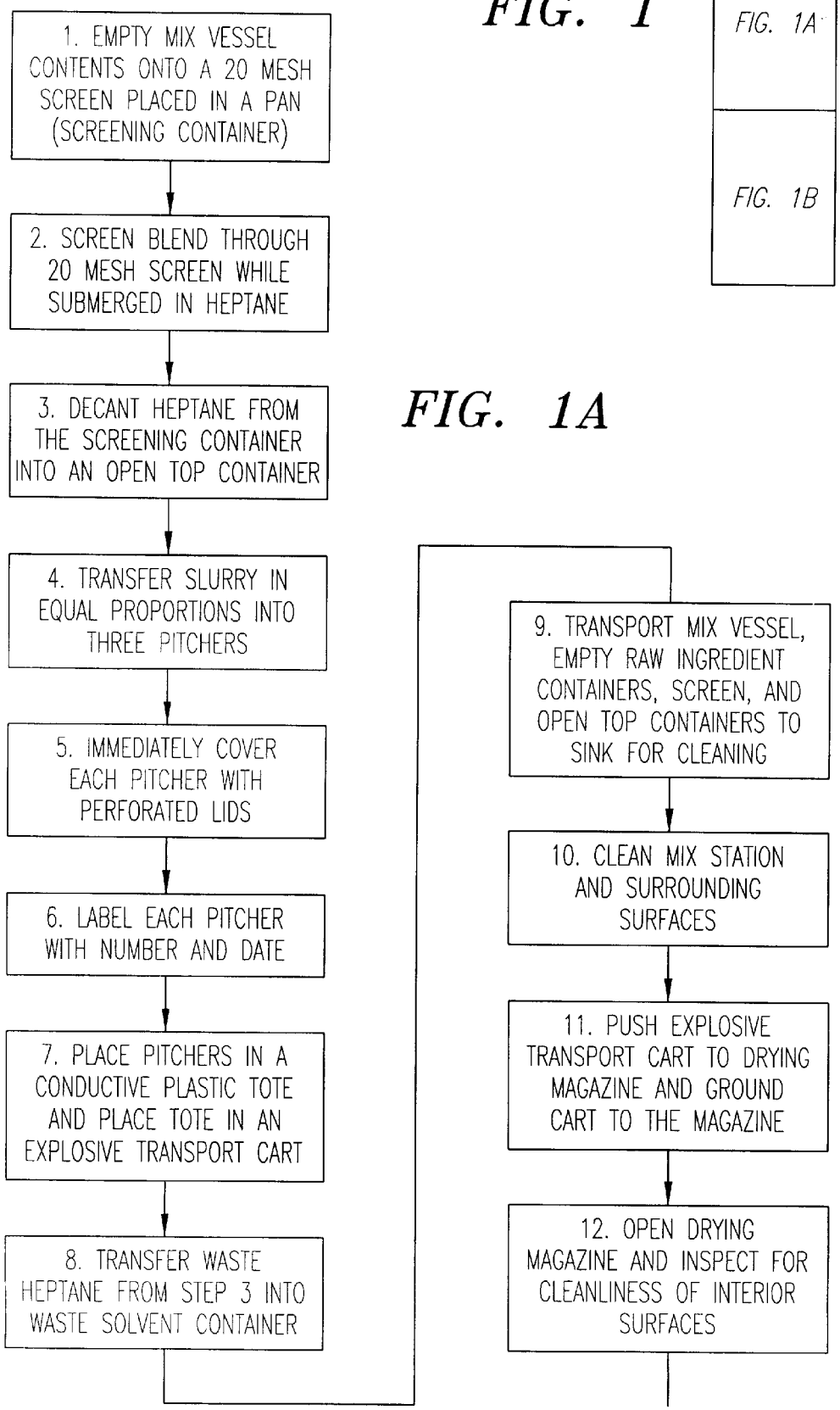
Figure 1B:
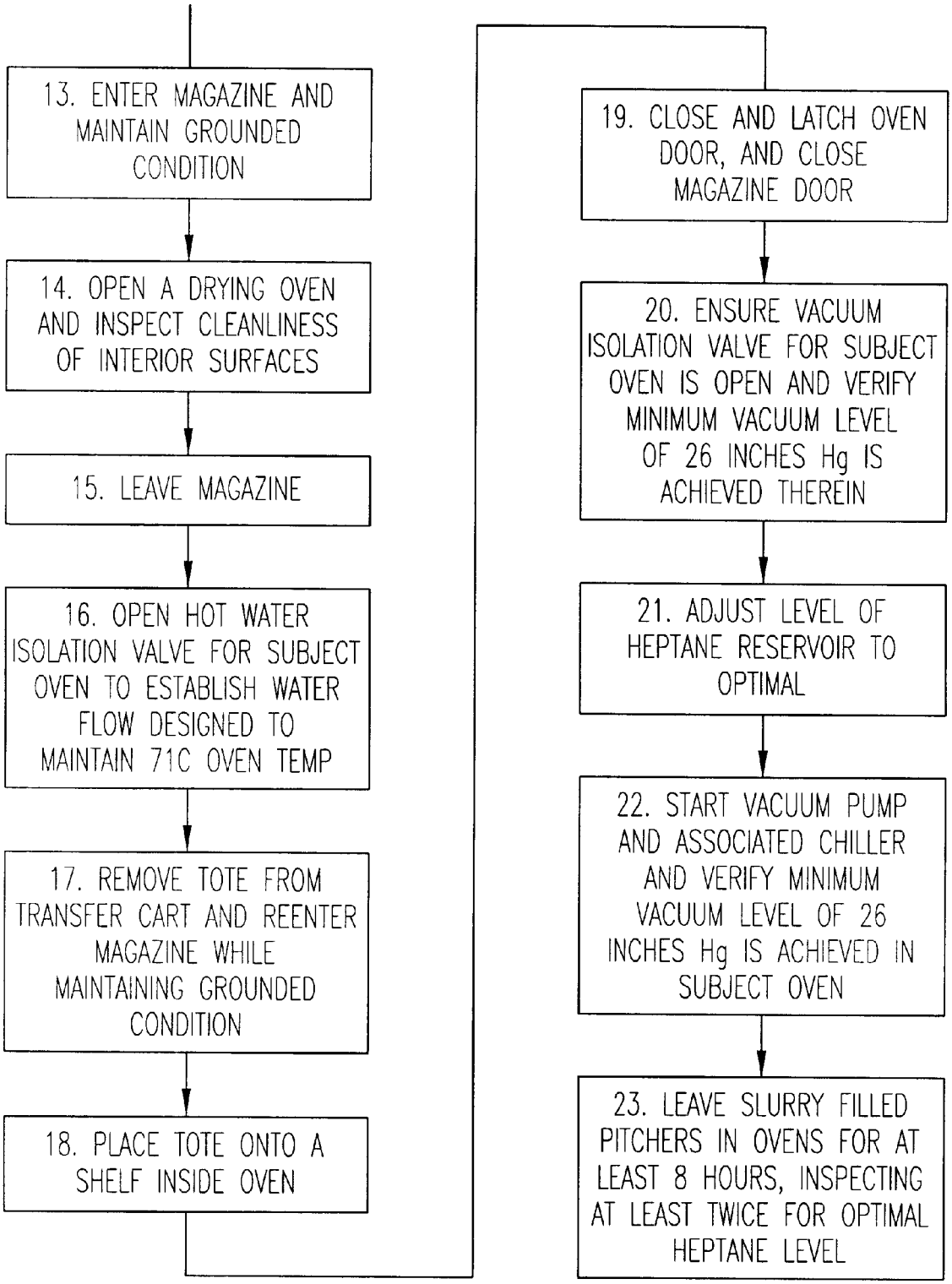

The FIGURE is a process flow diagram of a preferred embodiment of drying a slurry of adhesive particles and counter-solvent so as to produce individuated particles. The process depicted in the FIGURE is for use with a slurry of Zirconium-Potassium Perchlorate-Viton B ("ZPP") produced by precipitation as generally discussed above, with the blending solvent being acetone, the counter-solvent being heptane, and the elastomeric rubber binder being Viton B. Although the exact process shown in the FIGURE is designed for and works well with a particular slurry make-up, it will be apparent to one skilled in the art that many variations of the depicted process can readily be imagined that are encompassed by the present invention. For example, the process can be used with other slurries, including ones comprising other pyrotechnic compositions (e.g., titanium hydride among others). Similarly, binders other than Viton-B can be used. Viton GLT, for example, has been shown to work in the same fashion according to the invention. Likewise, counter-solvents other than heptane can be used, such as hexane or other suitable polar counter-solvents in which the pyrotechnic particles and binder are not soluble. Also, the particular equipment set-up employed in the drying process depicted in the FIGURE can be varied, and is merely one example. One of ordinary skill in the art will further recognize that the temperature, pressure, and time parameters specified for the specific embodiment of the FIGURE can be varied without undue experimentation to optimize the drying of other counter-solvents, compositions, sizes, etcetera, encompassed by the present invention.

As can be seen in the FIGURE, in step 1 of the preferred embodiment, a wet slurry of counter-solvent and coated pyrotechnic particles resulting from the precipitation process is emptied onto a 20 mesh screen placed in a screening container pan. Note that the size of the screen can be varied, depending on the desired particle size produced by the foregoing precipitation process. Further steps of the embodiment are now described. In step 2, the blend is screened through the screen while submerged under heptane. In step 3, excess heptane is decanted from the screening container into an open top container. In step 4, the slurry is transferred in equal proportions into three pitchers. Once the counter-solvent is removed, the binder coating the pyrotechnic particles rapidly begins to dry. Thus, if the slurry is not transferred quickly enough (e.g., within around twenty minutes for the embodiment of the FIGURE to the vacuum drying oven, atmospheric air drying will cause the binder coatings (due to the adhesiveness of the binder before it has dried) to begin to aggregate into a cake rather than individually drying as granules or particles. The allowable time for transfer to the oven can be increased, however, by increasing the amount of heptane counter-solvent that is part of the slurry poured into the pitcher (e.g., in the embodiment of the FIGURE, by decanting less heptane from the screening container in step 3). This, on the other hand, may incur an appreciable increase in the drying time required.

The number, size, and aspect ratios of the pitchers are not very critical parameters, although a greater surface area to volume ratio may hasten drying. Different sized pitchers can be successfully used, with loads as small as 50 grams and as large as 500 grams or larger, and the pitcher configuration can largely be chosen to best accommodate the logistics of the overall drying operation. In a preferred embodiment, the pitchers can be made of a non-conductive material, such as rubber, that is not dissolved or otherwise degraded in the presence of the chosen counter-solvent.

Next, each pitcher is immediately covered with perforated lids (step 5), and labeled with a number and date (step 6). In step 7, the pitchers are placed in a conductive plastic tote which is in turn placed in an explosive transport cart. The waste heptane from step 3 is then transferred into a waste solvent container (step 8). The mix vessel, empty raw ingredient containers, screen, and containers are then transported to a sink for cleaning (step 9), and the mix station and surrounding surfaces are cleaned (step 10).

In step 11, the explosive transport cart is taken to a drying magazine where it is electrically grounded. In step 12, the drying magazine is opened and its interior surfaces are inspected for cleanliness. The technician then enters the magazine while maintaining an electrical grounding (step 13), and opens a drying oven and inspects the cleanliness of its interior surfaces (step 14). After leaving the magazine (step 15), the technician opens the hot water isolation valve for the subject oven to establish a hot water flow which is designed to maintain the subject oven at 71° C. (step 16). Note that a different temperature may be selected, and a varied temperature versus time profile could possibly be employed. In step 17, the tote is removed from the transfer cart and the technician reenters the magazine while maintaining a grounded condition.

In step 18, the tote is placed onto a shelf inside the oven. Then, the oven door is closed and latched, and the magazine door is closed (step 19). In step 20, the technician ensures that the vacuum isolation valve for the subject oven is open and verifies that a vacuum level of 26 inches Hg is achieved in the subject oven. In the embodiment of the FIGURE, a liquid heptane pump is used to apply the vacuum rather than a more conventional pump, the seals of which may be adversely affected by the evaporated heptane gas. If necessary, the level of heptane in the vacuum reservoir is adjusted (step 21). The vacuum level may be higher, e.g., 28 inches Hg, if desired and obtainable. A lesser degree of vacuum can be applied, although the turbulence of the drying process will be adversely affected or prevented if there is too little vacuum. The vacuum will need to be at least enough so that the temperature selected from step 15 (in this embodiment, 71° C.) meets or exceeds the counter-solvent's boiling point.

In step 22, the vacuum pump and associated chiller are started and the technician verifies that a vacuum level of 26 inches Hg is achieved in subject oven. Finally, in step 23, the ZPP slurry-filled pitchers are left in the ovens for at least 8 hours, with a technician inspecting at least twice during that time to ensure there is an optimal level of heptane. Alternately to step 23, a moisture check may be performed after some time, e.g., four hours, has elapsed since introduction into the oven to determine if a sufficient level of dryness has been obtained, e.g., no more than 0.05 weight percent liquid counter-solvent remaining. Such a moisture check may also be desired even after the full duration of the indicated drying time, to confirm adequate dryness. No danger per se is presented, however, by indefinitely leaving the granules in the oven at the drying temperature and pressure even after they have been dried.

Referring still to the last two mentioned steps of the process shown in the FIGURE, once placed in the heated vacuum oven, the slurry will turbulently boil for a period of time, generally one to two hours in this particular embodiment. The turbulence of the boiling prevents the binder from congealing between particles, thereby preventing the formation of an unusable "cake" that requires screening in a dry state. Instead, the binder coatings dry individually around the pyrotechnic particles onto which they were precipitated. As the process proceeds, the turbulence abates, but the particle coatings are by then sufficiently dry and non-adhesive that they no longer tend to aggregate. With further drying, virtually all of the heptane is evaporated off and only dry, individuated granules remain. Thus eliminated is the need to carefully force comparatively small batches of product through a screen, one at a time.

Although the FIGURE is given as an example, slurries of other compositions and particle and batch sizes may be dried similarly by adopting suitable pressure, temperature, and duration of the drying process based on principles and techniques of chemical engineering well known in the art. And, as noted above, it will be apparent to one skilled in the art that many of the foregoing steps can readily be modified, varied, or substituted to suit a particular situation while still practicing the invention taught herein. Further, although a preferred embodiment utilizes boiling of the slurry's counter-solvent to induce the requisite initial period of turbulent drying, other means, such as mechanical stirring and the like, can be employed within the scope of the present invention. For example, instead of boiling, the decanted slurry might be stirred (preferably by a non-conductive stirring means) at ambient temperature and pressure, or at specified temperatures and pressures, until such time as the particle's binder coatings have hardened sufficiently to no longer tend to aggregate into a cake. Other means could also be used to impose turbulence on the decanted slurry until sufficient dryness is achieved. Thus, the present invention is only limited as in the claims appended hereto.

What is claimed is:

1. A method for drying a wet slurry of adhesive particles of a pyrotechnic composition and a counter-solvent in order to produce non-adhesive, individuated particles, the method comprising evaporating counter-solvent from the slurry under turbulent conditions that last at least until the adhesiveness of the adhesive particles is reduced sufficiently that the particles no longer tend to cake together.

2. The method of claim 1, wherein said turbulent conditions do not last substantially longer than necessary to allow a sufficient reduction in the adhesiveness of the particles such that subsequent unagitated drying of the particles would not cause them to cake together.

3. The method of claim 1, further comprising the step of subsequently drying the slurry, under non-turbulent conditions, until substantially all of the counter-solvent has evaporated from the slurry.

4. The method of claim 1, wherein said turbulent conditions are produced by the imposition of temperature and pressure selected to cause an initial period of turbulent boiling of the counter-solvent.

5. The method of claim 2, wherein said turbulent conditions are produced by the imposition of mechanical agitation of the slurry such as by a stirrer.

6. The method of claim 4, wherein the slurry is placed while still wet, in a vessel, into an oven maintained at said temperature and pressure selected to cause an initial period of turbulent boiling of the counter-solvent.

7. A method for drying a wet slurry of pyrotechnic particles and a counter-solvent, the method comprising:

a) passing the wet slurry through a screen and then introducing it into a non-conductive vessel;

b) placing said vessel into a drying vacuum oven; and c) leaving said vessel in said drying vacuum oven while said oven is maintained at a specified temperature and vacuum for a specified period of time wherein said specified temperature, vacuum, and period of time are together selected to result in an initial period of turbulent boiling off of counter-solvent from said slurry such that the pyrotechnic particles are allowed to dry without caking together.

8. The method of claim 7, wherein said specified period of time comprises said period of initial turbulent boiling off and an ensuing period of static evaporation that lasts at least until the pyrotechnic particles attain a level of dryness at which they can be used in their desired pyrotechnic application.

9. The method of claim 7, wherein the pyrotechnic particles are produced by a precipitation method.

10. The method of claim 9 wherein said pyrotechnic particles comprise Zirconium-Potassium Perchlorate coated with Viton B.

11. The method of claim 10 wherein said counter-solvent is heptane.

12. The method of claim 11, wherein said specified temperature is approximately 71 degrees Celsius, said specified vacuum is between 26 and 28 inches of mercury, and said specified period of time is four to eight hours.

13. The method of claim 7, wherein said non-conductive vessel is made from rubber.

14. The method of claim 7 wherein said screen is a 20 mesh screen.

15. The method of claim 7, further comprising steps to ensure grounding of the technician performing the method, and grounding of conductive equipment employed in the method.

16. The method of claim 7 wherein said vessel is covered with a perforated top after said slurry is introduced therein, and prior to said vessel being placed in said oven.

17. The method of claim 8, further comprising the step of removing said vessel from said oven and storing the dried granular pyrotechnic particles in said vessel.

18. A method for drying a wet slurry including precipitation method-produced Zirconium-Potassium Perchlorate Viton B ("ZPP") particles and a heptane counter-solvent, the method comprising:

a) passing the slurry through a 20 mesh screen while rinsing with heptane, b) decanting the slurry and placing it in a non-conductive vessel;

c) promptly placing said vessel into a drying vacuum oven; and d) leaving said vessel in said oven for a specified period of time while said oven is maintained at a temperature of approximately 71 degrees Celsius and at vacuum of between 26 and 28 inches of mercury, so as to result in turbulent boiling off of counter-solvent from said slurry such that the ZPP particles therein are allowed to dry without caking together.

19. The method of claim 18, further comprising the step of removing said vessel from said oven and storing the dried granular pyrotechnic particles in said vessel.

20. The method of claim 18 wherein said vessel is covered with a perforated top after said slurry is introduced therein, and prior to said vessel being placed in said oven.

21. The method of claim 18, wherein said specified period of time is between four to eight hours.

* * * * *